US005274884A

United States Patent [19]

Demuth et al.

[11] Patent Number: 5,274,884

[45] Date of Patent: Jan. 4, 1994

[54] MAINTAINING A PREDETERMINED QUALITY OF SLIVER IN A CARD AND/OR DRAWFRAME

[75] Inventors: Robert Demuth, Nürensdorf; Urs Meyer, Niederglatt, both of Switzerland

[73] Assignee: Maschinenfabrik Rieter AG, Winterthur, Switzerland

[21] Appl. No.: 743,092

[22] Filed: Aug. 9, 1991

Related U.S. Application Data

[62] Division of Ser. No. 549,756, Jul. 9, 1990, Pat. No. 5,067,202.

[30] Foreign Application Priority Data

Jul. 26, 1989 [CH] Switzerland ..... 02788/89

[51] Int. Cl.[5] ..... D01H 5/00; D04H 11/00

[52] U.S. Cl. ..... 19/236; 19/157; 19/159 R

[58] Field of Search ..... 19/65

[56] References Cited

U.S. PATENT DOCUMENTS

| | | | |
|---|---|---|---|
| 3,703,023 | 11/1972 | Krauss et al. . | |
| 3,862,473 | 1/1975 | Felix et al. . | |
| 3,884,026 | 5/1975 | Yoshizawa et al. | 19/159 A |
| 4,019,225 | 4/1977 | Nayfa . | |
| 4,369,550 | 1/1983 | Meile | 19/240 |
| 4,477,945 | 10/1984 | Vignon et al. | 19/159 A |
| 4,535,511 | 8/1985 | Leifeld et al. | 19/300 X |
| 4,683,619 | 8/1987 | Langen et al. | 19/159 A |
| 4,688,300 | 8/1987 | Langen et al. | 19/159 A |
| 4,697,310 | 10/1987 | Raasch | 19/159 A |
| 4,823,597 | 4/1989 | White | 19/157 X |
| 4,928,353 | 5/1990 | Demuth et al. | 19/300 X |
| 4,962,569 | 10/1990 | Hosel | 19/106 R |
| 4,987,649 | 1/1991 | Meyer et al. | 19/159 A |
| 4,995,140 | 2/1991 | Guenkinger et al. | 19/159 A |

FOREIGN PATENT DOCUMENTS

| | | | |
|---|---|---|---|
| 587418 | 11/1959 | Canada . | |
| 0220945 | 5/1987 | European Pat. Off. . | |
| 371391 | 11/1989 | European Pat. Off. | 19/159 A |

*Primary Examiner*—Clifford D. Crowder
*Assistant Examiner*—Michael A. Neas
*Attorney, Agent, or Firm*—Sandler, Greenblum & Bernstein

[57] ABSTRACT

The present invention is directed to a drawframe having a sliver delivery device and a computer part for maintaining a predetermined quality of sliver, wherein there is a predetermined overproduction from a card and/or a drawframe relative to a spinning machine. The arrangement temporarily decreases production to temporarily compensate for the overproductions. The sliver which is produced during the decrease in production may be delivered to a separate can.

2 Claims, 3 Drawing Sheets

MAINTAINING A PREDETERMINED QUALITY OF SLIVER IN A CARD AND/OR DRAWFRAME

This is a divisional of Ser. No. 07/549,756 filed Jul. 9, 1990 now U.S. Pat. No. 5,067,202.

BACKGROUND OF THE INVENTION

The invention relates to a method of maintaining a predetermined quality of a carded sliver produced in a card and/or drafted in a drawframe, the sliver being delivered into a can be a sliver delivery device in a continuous spinning mill process.

The actual spinning machine which produces the yarn end product is of course the costliest machine in the spinning process and is therefore required to operate at maximum efficiency—i.e., to have very short downtimes.

The various machines before and after the spinning machine are therefore so designed performance-wise as to overperform relative to the spinning machine so that the same does not have to wait for the feeding of its feedstock nor for subsequent processing, for example, in a winder.

The overperformance system applies to all the machines involved in the feeding of the feedstock for the spinning machine—i.e., in the blowroom of a spinning mill—viz. as will be described hereinafter with reference to drawings, any machine in the working process has a higher output than the machine immediately following it. This is how the present day machine park in spinning mills has evolved; however, if a blowroom process has to be performed by a machine considerably more expensive than a following machine (excluding the spinning machine), the previous machine may of course have a shorter downtime than the subsequent machine for the sake of economic balance.

These differences in performance can of course be compensated for by buffer stores of product which will vary in size in dependence upon the difference between the performance of the previous stage and the performance of the next stage. Clearly, large buffer stores are undesirable for purely economic reasons and in the course of spinning mill automation systems must be devised throughout from bale opening to end product either to eliminate the known manual intermediate buffer stores or at least so to organize them so that they are automatable.

SUMMARY OF THE INVENTION

The problem which the inventor had to address was therefore to optimize the performance steps in a spinning mill blowroom as to minimise the size of the buffer stores for intermediates and to facilitate automation.

To solve the problem, according to the invention, the card and/or drawframe, which each have a predetermined overproduction relative to a spinning machine associated with the process, have a predetermined temporary decrease in production which temporarily compensates correspondingly for the overproduction.

Also suggested for performing the method is a drawframe wherein the drawframe control has a computer part which at the changeover to decreased production effects the programmed slowdown and, if applicable, the stoppage and at the changeover from decreased production effects the programmed acceleration preceded, if applicable, by restarting.

Also suggested for performing the method is a combined card and drawframe system wherein the drawframe system has a supply of cans and, disposed in such supply, a can row with a can counter and the same responds to the presence of a predetermined number of cans in the row by outputting a signal.

The advantage of the invention is that it offers a basis for optimising profitability and a possibility for automation.

BRIEF DESCRIPTION OF THE DRAWINGS

The invention will be described in greater detail hereinafter with reference to embodiments.

In the drawings.

DETAILED DESCRIPTION OF THE PREFERRED EMBODIMENTS

Figure 1:
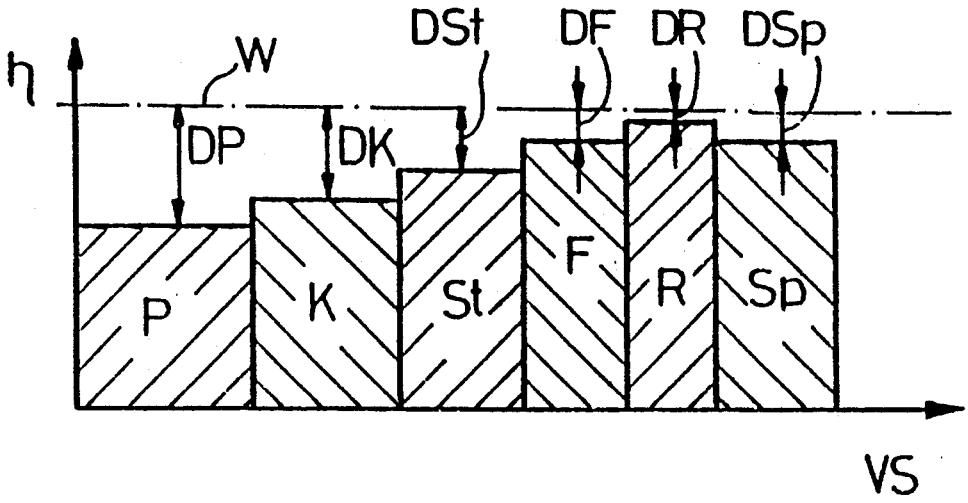
FIG. 1 is a diagram showing the efficiency of various items of spinning mill machinery.

FIG. 1 is an efficiency diagram of a number of spinning mill machines in which total or maximum efficiency is represented by a chain-dotted line W and the downtimes of the various machines are illustrated (in purely diagrammatic form) by means of spacer arrows DP, DK, DST, DF, DR and DSP.

The letters in the hatched rectangles have the following meanings:

| |
|---|
| The letter P denotes blowroom machines |
| The letter K denotes cards |
| The letter ST denotes drawframes |
| The letter F denotes roving frames |
| The letter R denotes ring spinning machines |
| The letter SP denotes winders |

The rectangles containing the letters P to SP are purely diagrammatic representations of machine performances or outputs, their areas being such that the area of any machine type is less than the area of the immediately previous type except for the area representing the winders, which is greater than the area representing the ring spinning machines. The aim of the diagram is to visualize the decrease in output as seen from the blowroom machines up to and including the ring spinning machine, the differences between the areas being exaggerated so that the differences can be more clearly visualized. Also, the areas shown are not in their actual relation to downtime and the latter too is shown for the sake of clarification with greater differences than are usually found in practice.

Figure 2:
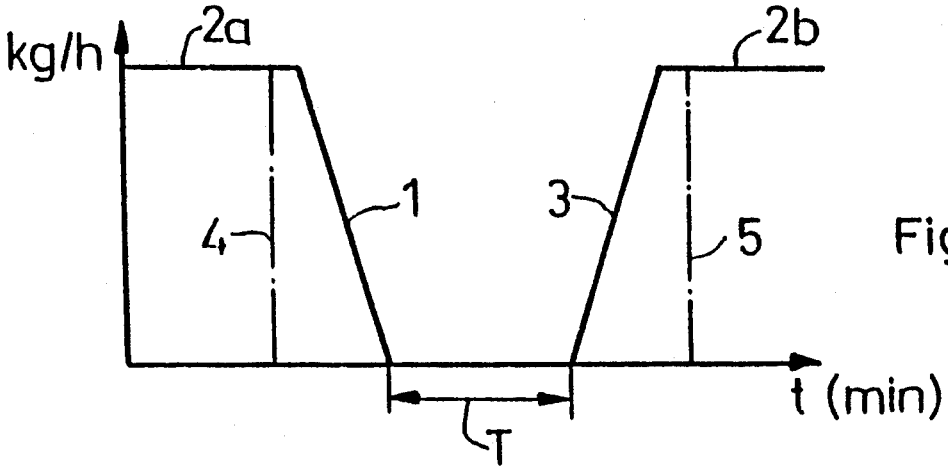
FIG. 2 is an illustration in graph form of the method steps according to the invention.
Figure 3:
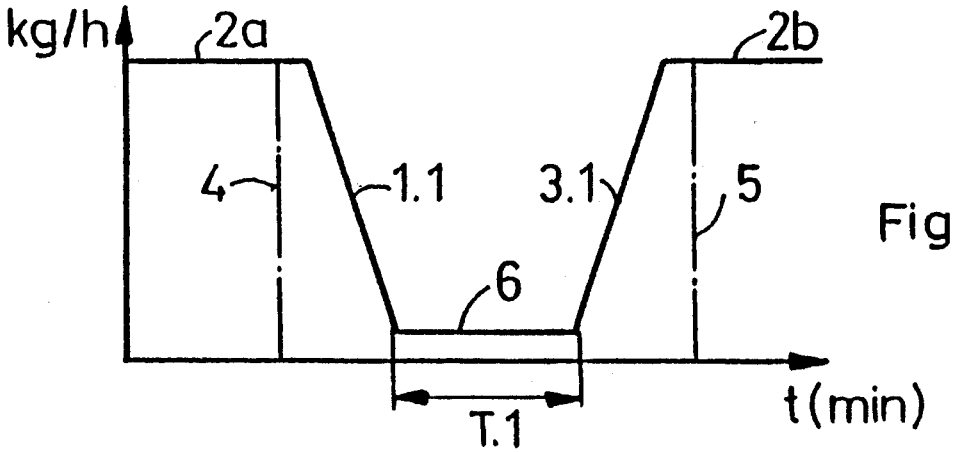
FIG. 3 shows a variant of FIG. 2.

Correspondingly, in the co-ordinate system shown in FIGS. 2 and 3, efficiency is plotted along the ordinate and the steps of the method along the abscissa. As previously stated, the steps of the method are:

Blowroom=P

Card room=K

Drawframe=ST

Roving frame=F

Ring spinning machineq=R

Winding room=SP

Of the machine types P to F the card is the most complex—i.e., a machine in which a large number of technical and technological functions must co-operate if a uniform and high-quality card sliver is to be produced.

Consequently, the co-operation between the various functions does not of course lead to absolutely the same result as regards sliver quality in all the performance steps and the same assumption is made further on in the production process—i.e., in drafting and in the roving frame—so that it may be necessary to separate out the carded sliver in the event of substantial output changes.

In the method acording to the invention, to link this elimination of a sliver which cannot be used in the subsequent stages with can changing in the card, when it is required to decrease card output, the card continues to produce at its normal output until can changing becomes necessary, the card being changed over to decreased output shortly after can changing, either until stoppage of the card or until further production at a minimum output step.

The decrease in production occurs with a slowdown of the kind represented by a line 1 in FIG. 2, where the card is brought to a standstill, then restored after a controlled time T to full output represented by lines *2a*, *2b*, a line 3 representing this acceleration.

Chain-dotted lines 4, 5 indicate the activation times for can changing, the line 4 denoting the activation time before the slowdown 1 while the line 5 denotes the changeover time for further can changing after the acceleration 3, whereafter the silver produced on full output is delivered into the next can.

Consequently, no silver produced on decreased output can be delivered into a "good" can intended to receive only silver which has been produced on full output.

FIG. 3 shows the same principle except that output is not reduced to zero as it is in FIG. 2; instead the card continues to produce at a very low output, for example, 10% of normal output until the control instruction for acceleration back to normal output is given.

The advantage of the method shown in FIG. 3 is that cards which cannot be completely guaranteed to produce breakage-free sliver until the card stops can continue to produce on low output without a large quantity of waste sliver accumulating. The decrease in production shown in FIG. 3 is represented by a line 6. Since the other lines relate to functions substantially corresponding to the functions of FIG. 2, the latter lines have the index 1 added to their references.

Figure 4:
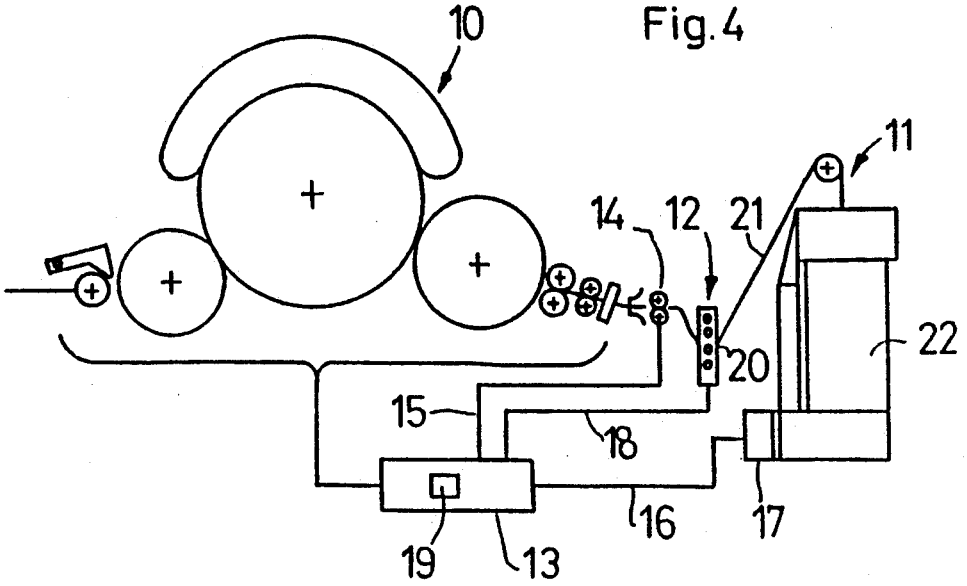
FIG. 4 is a diagrammatic view of a card having a sliver delivery device, the view being in cross-section.

FIG. 4 is a view in cross-section of a known card 10 having a known sliver delivery device 11 and, disposed between the same and the card 10, a known sliver loop sensor 12.

The card 10 is a card produced by the Applicants and sold world-wide as type C4/C1 and the facility comprising the elements 11, 12 is sold by the Applicants world-wide as type CBA.

The two combined machines were presented to the public, for example, at the 1989 American Textile Machinery Exhibition (ATME) in Greenville.

The card 10 and the device 11 operate through the agency of a control 13 which triggers the card with the necessary output-controlling signals and which imposes on the deliver device 11 a sliver delivery corresponding to card output, sliver delivery being adapted by means of the sliver loop control 12 to the alteration in card output in dependence upon the alteration thereof.

Sliver output—i.e., the weight of sliver produced per unit of time—is measured by means of a measuring roller pair 14 at the card exit and communicated by means of a measuring signal 15 to the control 13. The same deduces from the signal 15 an output-controlling signal 16 which controls the motor 17 driving the delivery device 11.

Alterations in sliver delivery after the roller pair 14 are recorded by the sensor 12 and communicated by means of a signal 18 to the control 13 so that by means of the signal 16 the motor 17 has its speed varied in accordance with the change in output.

A novel feature provided by the invention is that the control 13 has a computer attachment which is indicated in purely diagrammatic form by the reference 19 and which responds to the operation of a switch to be described hereinafter by decreasing card output in accordance with either FIG. 2 or FIG. 3, further operation of the same switch accelerating the card in the manner shown in FIGS. 2 and 3.

The decrease in output and the acceleration of the card cause a change in the position of loop 20 of the sliver 21 which the card 10 produces and which the device 11 delivers into a can 22. This change in the position of the loop 20 produces corresponding signals 18 so that the delivery device 11—i.e., motor 17 thereof-either slows down or accelerates the device 11 correspondingly. This feature provides the advantage that no additional synchronization between the card motors and the motor 17 driving the device 11 is required.

Figure 5:
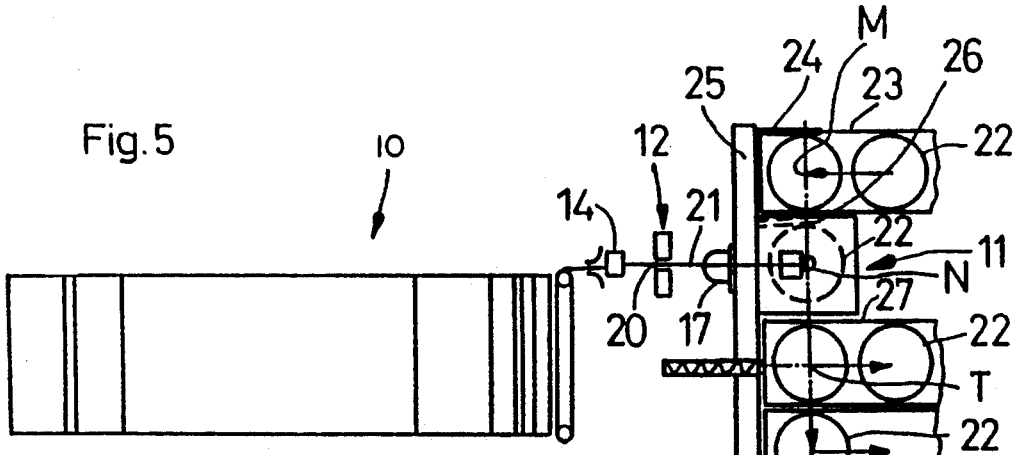
FIG. 5 is a diagrammatic plan view of the card of FIG. 4.

FIG. 5 is a plan view of the card 10 and delivery device 11 and also shows the sliver loop sensor 12.

Like elements in FIGS. 4 and 5 have the same references.

As previously stated, the device 11 is known from the publication. A novel feature provided by the invention is that the entering empty cans are conveyed by a conveyor belt 23 as far as an exit position M in which a displacing arm 24 of can displacer 25 moves the can into sliver delivery position N in which sliver is introduced into the can.

The can which has been filled with good sliver is moved by a second displacing arm 26 into a first removal position T on a conveyor belt 27 while a can which has been filled with a low-output sliver is moved into a second removal position Q on a conveyor belt 28. The computer part 19 controls these operations.

The arms 24, 26 can so pivot (not shown) as to be pivoted from a vertical position, in which they can be moved past the stationary cans, into a horizontal position in which they can displace the cans. The arms 24, 26 are parts of the delivery device 11.

The significance of the conveyor belts 23, 27, 28 will be described in greater detail with reference to FIG. 6.

Figure 6:
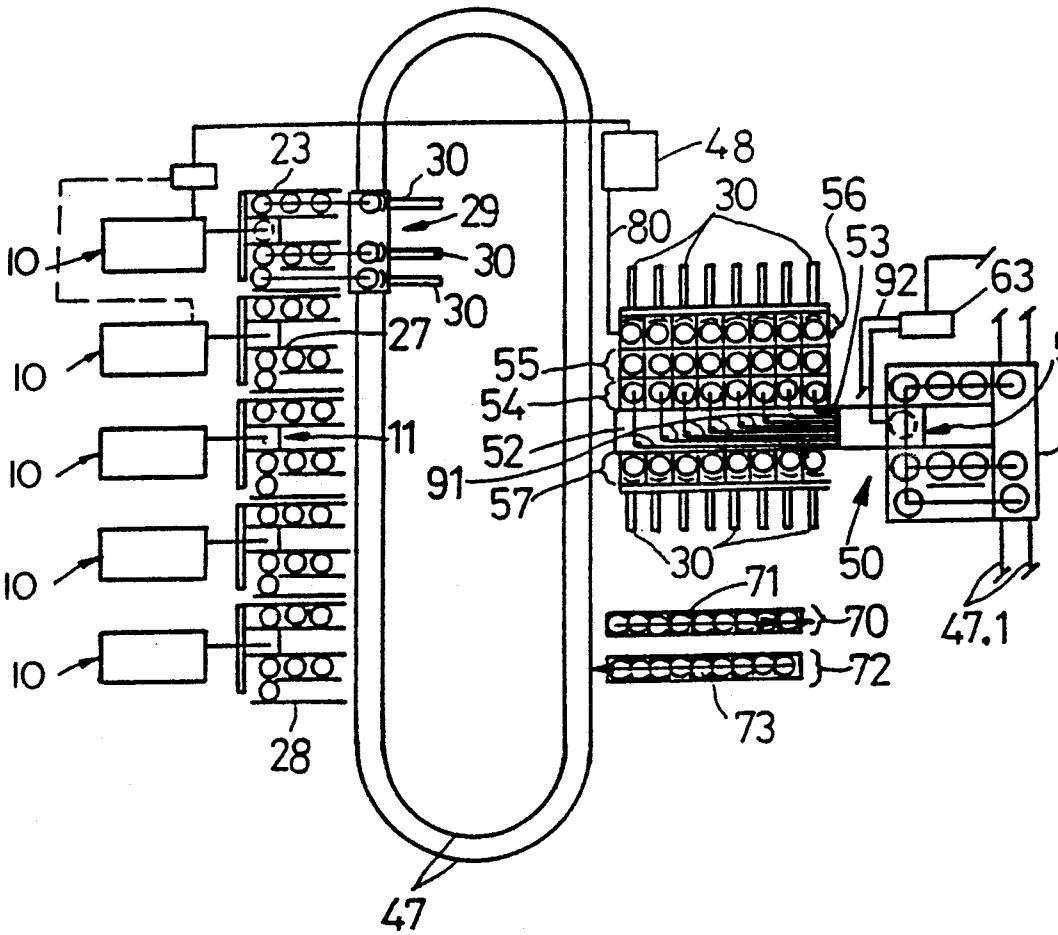
FIG. 6 is a diagrammatic plan view of a combined card and drawframe system.

FIG. 6 shows a number of cards 10 so disposed parallel to and adjacent one another that the conveyor belts 23, 27, 28 extend to a can conveyor 29. The cans on the conveyor belts are moved in directions indicated by arrows in FIGS. 5 and 6—i.e., the cans on the belt 23 are moved towards the can delivery and the cans on belts 27, 28 are moved towards the can conveyor 29. The cans on the belt 23 are empty cans, the cans on the belt 27 are full cans and the cans on the belt 28 are cans containing the sliver produced with the card on decreased output so that a can may have any level of filling.

Figure 8:
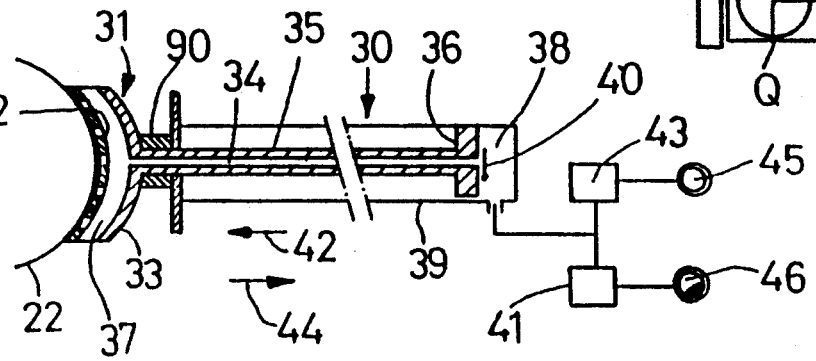
FIGS. 7 and 8 are each a view to an enlarged scale of a detail of the system shown in FIG. 6.

So that the cans can either be pushed off the conveyor 29 on to the belt 23 or pulled off the belts 27, 28 on to the conveyor 29, the conveyor 29 has pneumatic reciprocating actuators 30, the operation of which is shown in greater detail in FIG. 8. As can be gathered therefrom, the actuators comprise a suction and shifting shoe 31 adapted to the diameter of the cans 22 and having an air-permeable but plastically deformable wall 32 which is adapted to can diameter and which covers a hollow member 33 associated with a bore 34 extending through piston rod 35 and piston 36, so that cavity 37 communicates with pressure chamber 38 of cylinder 39.

At its end near the delivery chamber, the bore 34 has a check flap 40; when the chamber 38 is maintained at a positive pressure by way of a compressed air valve 41 connected to the chamber 38, the flap 40 closes the bore 34 so that the piston 36 and, therefore, the shoe 31 can move in the direction indicated by an arrow 42.

When, however, a suction valve 43, which is also connected to the chamber 38, is open instead of the compressed air valve 41, the chamber 38 is at a negative pressure, so that the flap 40 opens and the cavity 37 is at a negative pressure. The negative pressure sucks tightly on to wall 32 of a can 22 in contact therewith which is also displaced together with the shoe 31 in the direction indicated by an arrow 44 until the hollow member 33 contacts an abutment 90 limiting this movement in the direction 44.

Sensors detecting the position of the shoe 31 for the valves 41, 43 to be changed over by means of a control (not shown) are not shown here.

The suction valve 43 is connected to a suction source 45 and the compressed air valve 41 to a compressed air source 46.

By means of a pneumatic reciprocating actuator 30, empty cans are pushed off the can conveyor 29 on to the conveyor belt 23 and full cans are pulled off the conveyor belt 27 on to the conveyor 29; the cans are also pulled off the belt 28 on to the conveyor 29.

The can conveyor 29 is movable on rails 47. A control station controlling movement of the can conveyor 29 is illustrated diagrammatically in the form of a rectangle having the reference 48; it is the subject of the Applicants' patent application No. CH 0 4410/88-1 and is not further described here.

A drawframe 50 is contiguous with the rails 47 and is disposed on a side remote from the cards of the rail oval shown in FIG. 6; the drawframe 50 takes over the cans filled by the cards 12 and processes their sliver. A drawframe of this kind is known and, for example, sold by the Applicants world-wide under the designation D1.

The drawframe includes the actual drafting unit 51 which drafts slivers 53 infed on a feed table 52.

The slivers 53 are delivered from can row 54 in which emptying cans are disposed. Can row 55, which extends parallel to row 54, consists of full cans in a reserve position. Can row 56 which is parallel to and in FIG. 6 immediately above row 55 is another full-can row but a row adapted to take up full cans from the conveyor 29.

On the bottom side of the feed table 52, looking at FIG. 6, a row of empty cans 57 stands ready parallel to the feed table 52 for transfer to the can conveyor 29.

Figure 7:
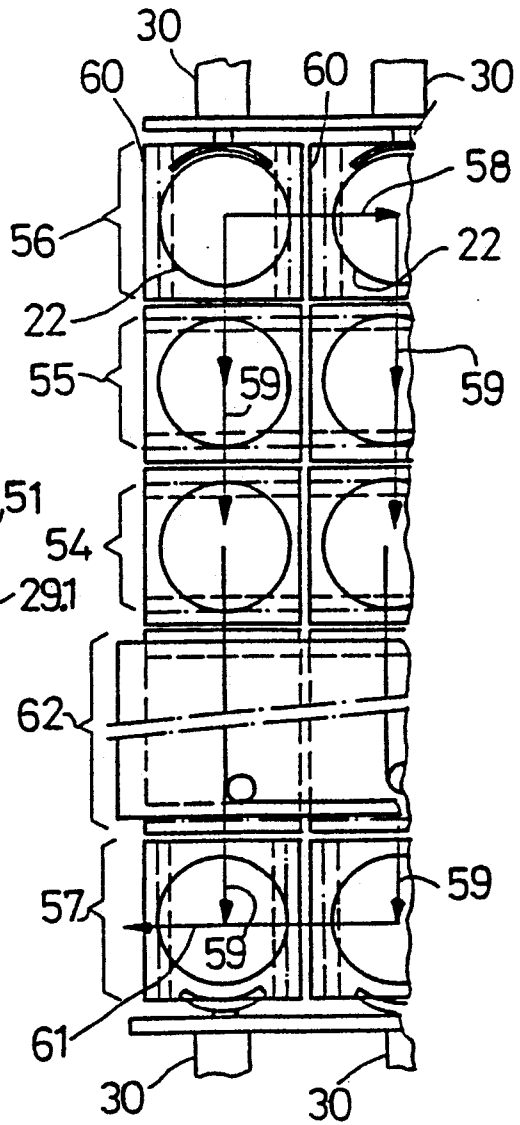

This can arrangement just described is shown more clearly and to an enlarged scale in FIG. 7. As will be apparent, the cans of row 56 can be moved both in the conveying direction 58 and in the conveying direction 59, movement in the direction 58 being producted by discrete conveyor belts 60 disposed in adjacent end-to-end relationship to one another whereas the cans 52 can be moved in the direction 59 by reciprocating actuators 30. The same move the cans 22 from row 56 to row 55. Conveyor belts 60 are provided to move the cans 22 in the rows 55, 54 but are at a 90° offset in their conveying direction from the conveyor belts of the row 56 so that the cans are moved in the direction 59.

The cans emptied in the row 54 are moved through below the feed table 52 by means of another row of conveyor belts which move the cans so far in the direction 59 that the cans can be drawn by further actuators 30 on to the conveyor belts of the row 57. The cans move in the direction 61 on the latter belts for conveyance towards the can conveyor 29. Instead of the discrete conveyor belts of the row 57 shown in FIG. 7, a single conveyor belt (not shown) can be used.

Cans are displaced into the next row—i.e., e.g., from row 56 into row 55 and so on—when the cans in row 54 are empty, a state which is detected by a sliver sensor (not shown) on the feed table 52, for example, at the deflections 91 which deflect the sliver through 90°, and which is fed into a control 63 as a signal 92 (not completely shown). The control 63 initiates activation of whichever conveyor belts and reciprocating actuators move the cans in the direction 59—i.e., the conveyor belts 55, 54, 62 and the actuators 30 for both pushing and pulling the cans.

The control 63 is also responsible for moving the cans in the drawframe 50 in good time—i.e., changing full cans for empty cans—something which is performed in basically the same way as described with reference to the cards 12 and indicated by corresponding arrowed directions. The actual drafting unit 51 of the drawframe 50 is controlled by means of an associated computer part for both stop-start operation and low-output operation.

A can conveyor 29.1 is provided for the drawframe 50 in just the same way as for the cards 12 and has the same function as the conveyor 29 but it conveys the full and empty cans to a machine which follows the drawframe, such as one or more roving frames.

The cans previously described which contain sliver produced during low-output operation of the cards 12 and which are supplied with the sliver 28 to the can conveyor 29 are delivered thereby to a standby row 70 in which the cans are conveyed on a conveyor belt in a direction 71 so that they can be received by further means (not shown) and conveyed to a clearing station (not shown), whence empty cans return and are introduced into a standby row 72 also in the form of a conveyor belt so operated that the empty cans can be conveyed in a direction 73 towards the can conveyor 29 and delivered thereto.

The can-displacing arrangement for the drawframe 50 corresponds basically to the arrangement described for the cards 12 and so will not be described and illustrated again. Similar considerations apply to the standby position of the full and empty cans containing sliver of below normal quality so that this sliver is cleared in the clearing station.

Basically, however, output can be controlled down to zero with the drawframe 50 without any loss of quality in the drafted sliver so that the conveyor belt and the corresponding function associated with reception of the cans, similarly to the cans on the belt 28, can be omitted.

Finally, the row 56 has a can detector which by means of a signal 80 informs station 48 of the number of cans present in the row.

We claim:

1. In a combination of a drawframe having a drafting unit and a sliver delivery device, said drawframe comprising a control device for controlling preselected basic capacities of the drafting unit and of the sliver delivery device, the improvement comprising:

said control device including a computer means for maintaining a predetermined quality of the drafted sliver by effecting a programmed slowdown of the capacities of the drafting unit and of the sliver delivery service, at a changeover from said basic capacities to decreased production at which a waste sliver is produced, said computer means effecting a programmed acceleration of the drafting unit and of the sliver delivery device after said decreased production to reach said preselected basic capacities, and a standby can conveyor, wherein waste sliver produced during decreased production is fed to a can located on said standby can conveyor.

2. The combination of a drawframe having a drafting unit and a sliver delivery device according to claim 1, comprising a full can conveyor for feeding said drawframe, a sliver sensor for detecting when cans on said full can conveyor are empty, and a control which activates said full can conveyor in response to a signal from said sliver sensor.

* * * * *